United States Patent [19]

Schnapper et al.

[11] Patent Number: 4,523,562

[45] Date of Patent: Jun. 18, 1985

[54] METHOD FOR CONTROLLING THE FUEL METERING FOR AN INTERNAL COMBUSTION ENGINE

[75] Inventors: Martin Schnapper; Ernst W. Hufendiek, both of Stuttgart, Fed. Rep. of Germany

[73] Assignee: Daimler-Benz Aktiengesellschaft, Fed. Rep. of Germany

[21] Appl. No.: 508,239

[22] Filed: Jun. 27, 1983

[30] Foreign Application Priority Data

Jul. 5, 1982 [DE] Fed. Rep. of Germany ..... 3225085

[51] Int. Cl.[3] ..... F02D 31/00

[52] U.S. Cl. ..... 123/357; 123/367; 123/372; 73/119 A

[58] Field of Search ..... 123/357, 358, 359, 367, 123/372; 73/119 A

[56] References Cited

U.S. PATENT DOCUMENTS

| | | | |
|---|---|---|---|
| 3,724,430 | 4/1973 | Adler | 123/357 |
| 3,757,750 | 9/1973 | Ohtani | 123/357 |
| 4,270,502 | 6/1981 | Seilly | 123/357 |
| 4,343,274 | 8/1982 | Butscher | 123/357 |

FOREIGN PATENT DOCUMENTS

| | | | |
|---|---|---|---|
| 4123 | 1/1978 | Japan | 123/357 |
| 8222 | 1/1979 | Japan | 123/358 |
| 52534 | 5/1981 | Japan | 123/357 |
| 5523 | 1/1982 | Japan | 123/357 |
| 2062254 | 5/1981 | United Kingdom | 123/357 |

*Primary Examiner*—Magdalen Y. C. Moy
*Attorney, Agent, or Firm*—Craig and Burns

[57] ABSTRACT

In a method and apparatus for controlling the fuel metering for an internal combustion engine, an electrical displacement sensor is used for fuel injection pumps with an injection quantity control element, which is adjusted, via a control lever, proportionally to the electrical displacement sensor, whose displacement change causes an electrical signal proportional to this displacement change, this electrical signal being fed into an electronic control unit for readjusting the injection quantity control element.

In order to avoid supply quantity scatter, control can be directed towards a calibration point situated on a supply quantity characteristic of the fuel injection pump, this calibration point preferably being located in the region of the maximum fuel supply quantity, and the output voltage of the electrical displacement sensor can be compared with a specified required value.

5 Claims, 2 Drawing Figures

METHOD FOR CONTROLLING THE FUEL METERING FOR AN INTERNAL COMBUSTION ENGINE

Figure 1:
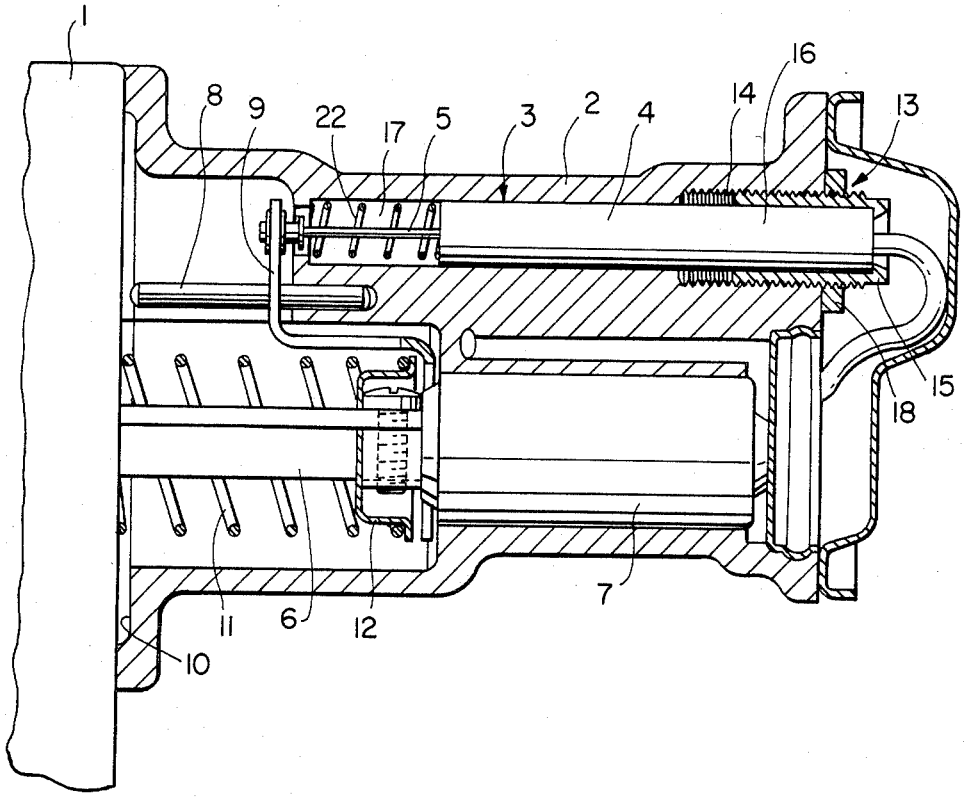

The invention relates to a method for controlling the fuel metering for an internal combustion engine wherein an electrical displacement sensor is used for fuel injection pumps with an injection quantity control element, which is adjusted, via a control lever, proportionally to the electrical displacement sensor, whose displacement change causes an electrical signal proportional to this displacement change, the electrical signal being fed into an electronic control unit for readjusting the injection quantity control element.

An electrical displacement sensor for fuel injection pumps with a speed controller and a control lever directly coupled to an injection quantity control element is known from German Offenlegungsschrift No. 2,909,624, in which electrical displacement sensor the movable sensor part operates directly together with the control lever so that a displacement of the control element causes a proportional displacement of the sensor part. In this arrangement, the fuel injection quantity is not measured directly but by the displacement of the sensor part, which is subject to scatter in the quantity supplied.

An object of the invention is to produce a method for controlling the fuel metering for an internal combustion engine, by means of which scatter in the supply quantity is avoided as far as possible, and to produce a device for carrying out this method, this device being characterized by simple construction and low manufacturing costs.

In accordance with the invention, this object is achieved advantageously in a system wherein control can be directed towards a calibration point (E) situated on a supply quantity characteristic of the fuel injection pump, which calibration point is preferably located in the region of the maximum fuel supply quantity, and the output voltage of the electrical displacement sensor can be trimmed to a specified required value.

In accordance with another object of the invention, an electrical displacement sensor for carrying out the aforedescribed method is provided formed by an induction coil and an inductive displacement sensor incorporating a ferrite core, the inductive displacement sensor being adjusted, by way of a control lever, proportionally to an injection quantity control element wherein a setting device is associated with the inductive displacement sensor by means of which setting device the relative position of the induction coil and the ferrite core can be influenced. In accordance with another object of the invention, an electrical displacement sensor is provided according to the aforedescribed structure wherein the setting device includes a shell which accepts an end region of the induction coil and can be axially displaced in the casing of the displacement sensor, it being possible by means of this shell to influence the position of the induction coil relative to the ferrite core against the spring force of a compression spring and in a guide bore of the displacement sensor.

In accordance with another object of the invention, as by the aforedescribed structure, the shell is located by a thread so as to be axially displaceable in the displacement sensor casing and can be locked by a lock nut.

The method in accordance with an object of the invention can be applied, at minimum outlay, to all known electrical displacement sensors for fuel injection pumps. In particular, this method has the advantage that fuel injection pumps and electronic control units for one engine type are freely exchangeable with one another without the accuracy of the injection quantity to be supplied being adversely affected in the process, and thus, scatter between engines can be trimmed out by the adjustment device.

Figure 2:
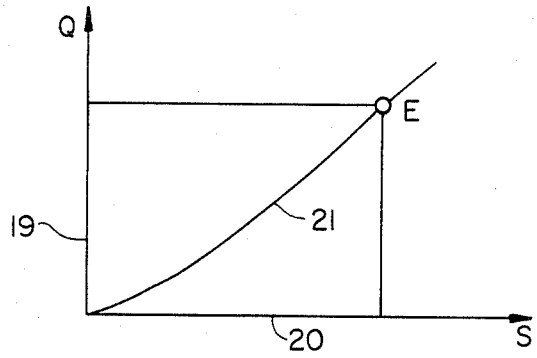

These and other objects, features, and advantages of the present invention will become more apparent from the following description when taken in connection with the accompanying drawings which show, for the purposes of illustration only, one embodiment in accordance with the present invention, and wherein:

FIG. 1 shows an indicated fuel injection pump with an electrical displacement sensor, in longitudinal section, and FIG. 2 shows the shape of a supply quantity characteristic with a calibration point situated on it.

The fuel injection pump 1 indicated in FIG. 1 is connected to a displacement sensor casing 2, in which are located an electrical displacement sensor 3—in the present case an inductive displacement sensor formed by an induction coil 4 and a ferrite core 5—and an activator piston 7, which can be influenced as a function of rotational speed and operates together with an injection quantity control element formed by a control rod 6. The ferrite core 5 can be displaced proportionally to the actuator piston 7 via a control lever 9 axially guided on a guide rod 8; the deflection of the actuator piston 7 can be influenced in a known manner by an electronic control unit (not shown). The control rod 6 is kept in effective connection with the actuator piston at any position by means of a compression spring 11 supported on an end wall 10 of the fuel injection pump 1 and a retaining shell 12 solidly connected to the control rod 6. The inductive displacement sensor 3 is associated with an adjustment device 13, by means of which the relative position of the induction coil 4 and the ferrite core 5 can be influenced independently of the actuator piston 7. The adjustment device 13 includes a shell 15 displaceable by means of a thread 14 coaxially to the displacement sensor 3 in the displacement sensor casing 2, which shell 15 accepts an end region 16 of the induction coil 4 limiting movement in one direction by a lip at one end of shell 15 and by means of which its position in a guide bore 17 of the displacement sensor casing 2 is variable relative to the ferrite core 5 against the spring force of a compression spring 22. The shell 15 can be locked by a lock nut 18.

While sensor 3 has been disclosed as comprising a ferrite core 5 and induction coil 4, those skilled in the art will appreciate that other electrical or electromechanical means may be employed for these elements wherein movement of the control rod 6 is translated into a corresponding electrical signal and wherein the signal may be calibrated by an electrical or mechanical means.

In FIG. 2, the electrical voltage S of the inductive displacement sensor 3 is entered on an abscissa 20 and the fuel output Q of the fuel injection pump 1 is entered on the ordinate 19. A supply quantity characteristic is shown by 21 and a calibration point on the supply characteristic 21 and preferably located in the region of the maximum fuel supply quantity is shown by E.

In order to avoid supply quantity scatter from the fuel injection pump as far as possible, it is necessary to associate the fuel supply quantity with the inductive displacement sensor signal. In accordance with the invention, this association is achieved by deflecting the actuator piston 7 and thus also the ferrite core 5 of the inductive displacement sensor 3 into a position preferably corresponding to the full load range of the internal combustion engine. The voltage of the displacement sensor proportional to the selected position, or supply quantity, is trimmed to a specified test stand voltage figure corresponding to this supply quantity. This trimming can take place by an adjustment, which is known per se, of the displacement sensor 3 or by the adjustment device 13, which can also be used as a fine adjustment device for trimming out scatter between engines.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A process for adjusting the actual fuel delivery volumes determined at a fuel injection pump for a Diesel internal-combustion engine having an electronic control unit for the control of the fuel injection, by means of a characteristic delivery volume line, to the fuel delivery volumes indicated by the control unit, said fuel delivery volumes, in each case, being proportional to the control path changes generated by the control unit by actuating signals at the actuating drive of the control rod of the injection pump and being detected by an electric displacement transducer coupled with the control rod and led to the control unit as electric signals, wherein the control rod is adjusted to a gauge point (E) located on the characteristic delivery volume line, said gauge point (E) preferably being located in the area of the maximum fuel delivery volume, wherein the output signal of the electric displacement transducer corresponding to the adjusted control rod position is compared with a desired voltage level fed in the control unit for the fuel delivery volume supplied in gauge point (E), and wherein, in the case of a divergence between the output signal and the desired voltage level, the displacement transducer is adjusted relative to the control rod until the output signal of the displacement transducer coincides with the desired voltage level.

2. A sensing system for an internal combustion engine having a fuel injection pump, the latter having a control rod, means for sensing displacement of the control rod comprising a first electrical means for displacement in response to movement of the control rod, a second electrical means mounted for movement with respect to the fuel pump for receiving an electrical effect from said first electrical means and means of displacing the second electrical means with respect to the fuel pump independently of displacement of said first electrical means by said control rod wherein said first electrical means comprises a core and said second electrical means comprises an induction coil for receiving said core.

3. A sensing system in accordance with claim 2, wherein said fuel pump has a displacement sensor casing mounted thereto, said means for displacement comprising a shell, threadedly mounted to said casing to receive an end region of the induction coil and limiting movement of the injunction coil in one direction, for adjusting the position of said induction coil with respect to the displaceable sensor housing.

4. A sensing system in accordance with claim 3 further comprising means for locking the position of said shell with respect to said casing.

5. A method of adapting actual delivery performance of a fuel pump to the control unit of an internal combustion engine comprising the steps of determining a relationship between actual delivery volume of the pump and the position of a displacement transducer of the control unit to produce a characteristic delivery volume line, establishing a delivery volume at a gauge point on the characteristic delivery volume line as a fixed desired delivery volume, establishing a value for a displacement transducer output voltage to correspond to the gauge point, producing an output voltage from the displacement transducer in response to the position of a control rod of said control unit, and adjusting the position of the displacement transducer to produce an output voltage therefrom substantially equal to the established value for displacement transducer output voltage corresponding to the gauge point.

* * * * *